US006022310A

United States Patent [19]

Goldberg et al.

[11] Patent Number: 6,022,310

[45] Date of Patent: Feb. 8, 2000

[54] CANOPY ADJUSTMENT MECHANISMS FOR THERMAL SUPPORT APPARATUS

[75] Inventors: Charles Goldberg, Cincinnati, Ohio; Rick A. Schmidt, Batesville; Rafael E. Aguilera, East Lawrenceburg, both of Ind.; D. Scott Prows, Cincinnati, Ohio

[73] Assignee: Hill-Rom, Inc., Batesville, Ind.

[21] Appl. No.: 08/925,981

[22] Filed: Sep. 9, 1997

[51] Int. Cl.[7] ..... A61G 11/00

[52] U.S. Cl. ..... 600/22

[58] Field of Search ..... 600/21, 22; 51/600, 51/603, 97, 284, 414

[56] References Cited

U.S. PATENT DOCUMENTS

| | | | |
|---|---|---|---|
| 3,858,570 | 1/1975 | Beld et al. . | |
| 4,161,172 | 7/1979 | Pickering . | |
| 4,750,474 | 6/1988 | Dukhan et al. . | |
| 4,809,677 | 3/1989 | Mackin et al. | 600/22 |
| 5,162,038 | 11/1992 | Wilker . | |
| 5,308,310 | 5/1994 | Roff et al. . | |
| 5,376,761 | 12/1994 | Koch et al. . | |
| 5,453,077 | 9/1995 | Donnelly et al. . | |
| 5,474,517 | 12/1995 | Falk et al. . | |
| 5,498,229 | 3/1996 | Barsky et al. . | |
| 5,830,123 | 11/1998 | Franz et al. | 600/22 |

FOREIGN PATENT DOCUMENTS 49-122184 of 1974 Japan .

OTHER PUBLICATIONS

"Stabilet® from Hill–Rom®" Product Brochure, six pages, 1992.

"Stabilet CC™ from Hill–Rom®" Product Brochure, six pages, 1992.

"The Stabilet™ Freestanding Warmer and Clinical Bassinet from Hill–Rom®" Product Brochure, four pages, 1993.

"A Hill–Rom Solution", Stabilet 2000C, Stabilet CC, Stabilet Freestanding Infant Warmer Accessories Product Brochure, eight pages, 1995.

"Isolette® Infant Incubator . . . The Essence of Incubation", Air–Shields, Inc. Product Brochure, eight pages, 1996.

"The New Isolette® Infant Incubator Only From Air–Shields" Product Brochure, one page Sep. 1996.

*Primary Examiner*—Samuel Gilbert
*Attorney, Agent, or Firm*—Barnes & Thornburg

[57] ABSTRACT

A patient-support apparatus having an overhead arm located over a patient support mounted on a base, a canopy mounted to the overhead arm and supported over the patient support by the overhead arm, and a mounting assembly for attaching the overhead arm to the base, including an alignment mechanism to properly align the overhead arm with respect to the patient support, wherein the alignment mechanism has at least two relatively movable members, which moveable members are also relatively movable with respect to the overhead arm and the base and are fixedly secured to each other, the overhead arm and the base after alignment of the overhead arm relative to the patient support.

39 Claims, 7 Drawing Sheets

CANOPY ADJUSTMENT MECHANISMS FOR THERMAL SUPPORT APPARATUS

BACKGROUND AND SUMMARY OF THE INVENTION

The present invention relates to patient support devices, and particularly, to infant thermal support devices of the type comprising a base with a patient support surface above the base and a canopy located over the patient support surface. More particularly, the present invention relates to mechanisms that raise and lower the canopy relative to the base and mechanisms that align the canopy over the base.

Thermal support devices, such as infant warmers and incubators, having an isolation chamber and various systems that maintain the isolation chamber at a controlled temperature and humidity to facilitate the development of a premature infant are known. Infant thermal support devices conventionally include a patient-support surface for supporting the infant in the isolation chamber and some type of overhead structure, such as a canopy, above the patient-support surface. In some cases, the isolation chamber is encompassed by a set of panels arranged around the patient-support surface. The canopy cooperates with the set of panels to enclose the isolation chamber.

Conventionally, access openings through which caregivers gain access to the infant are provided in either the canopy or the panels. In some infant thermal devices, the overhead structure includes radiant heaters that provide warmth to the infant. In other infant thermal devices, canopies are vertically adjustable relative to the patient support surface. In such thermal support devices, it is desirable that the canopy be vertically adjusted as quietly as possible and without vibration.

Infant thermal support devices having isolation chambers will sometimes include air circulation systems that provide curtains of moving air around the perimeter of the isolation chamber. The canopy of such thermal support devices oftentimes is arranged to direct the flow of air within the isolation chamber. Therefore, it is important for the canopy to be aligned over the patient-support surface to properly direct the flow of air. In addition, it is desirable for the canopy to be aligned with the set of panels that encompass the isolation chamber to minimize air and heat losses between the set of panels and the canopy. The overall aesthetics of the infant thermal support device also dictate that the canopy be aligned with both the patient-support surface and the set of panels.

According to the present invention, a patient-support apparatus includes a base, an overhead arm supported above the base, and an alignment mechanism for adjusting the position of the overhead arm relative to the base with respect to at least three different degrees of freedom and for providing subsequent rigidity of the overhead arm with respect to the base after alignment. A canopy is attached to the overhead arm after the alignment thereof. Essentially, the present invention comprises a base, a patient support on the base, a canopy located over the patient support, and a mounting assembly for attaching the canopy to the base. The mounting assembly includes a vertical arm, an overhead arm, and an alignment mechanism for coupling the overhead arm and vertical arm together and for aligning the overhead arm with respect to the patient support. In some preferred embodiments, the invention includes a drive mechanism for extending and retracting the vertical arm to raise and lower, respectively, the canopy relative to the patient support.

In embodiments of the present invention, the alignment mechanism provides for an initial adjustment of the overhead arm with respect to at least four different degrees of freedom, five different degrees of freedom, or six different degrees of freedom. Such an alignment mechanism may have at least two relatively movable members, i.e., relatively movable with respect to the overhead arm and the patient support, one member of which mounts to the overhead arm and the other member of which mounts to the patient support. One such movable member may be slidable in two orthogonal directions with respect to the patient support while the other movable member may be slidable in two orthogonal directions with respect to the overhead arm. In each case, the movable member may be rotatable about an axis that is orthogonal to a plane defined by the two orthogonal directions in which it is adjustable. It will be appreciated that, within the scope of the present invention, one movable member may be slidably movable in one direction with respect to the overhead arm and rotatable with respect to the patient support along an axis orthogonal with the slidable direction. Thus, the preferred alignment mechanism allows rotational adjustment of the overhead arm in roll, pitch, and yaw directions and translational adjustment of the overhead arm in vertical, transverse, and longitudinal directions.

In accordance with the present invention, an alignment method is provided for aligning an overhead arm, to which a canopy attaches, over a patient support with respect to at least three degrees of freedom. The patient-support apparatus is provided with an alignment mechanism which interconnects and supports the overhead arm above the patient support. The method comprises the steps of fixedly securing an alignment jig on the support device below the overhead arm, positioning the overhead arm on the alignment jig in correct alignment position as defined by the jig, loosely connecting the alignment mechanism to either the overhead arm or the patient support, loosely connecting the alignment mechanism to the other of the overhead arm or patient support, adjusting the alignment mechanism so as to be able to support the overhead arm in the correct alignment position when the loose connections are tightened, tightening the loose connections between the alignment mechanism and the overhead arm and between the alignment mechanism and the patient support, and then removing the alignment jig.

The canopy of the present invention may comprise at least one canopy section pivotably attached to the overhead arm to be movable between a position below the overhead arm to a position extending above the overhead arm, and a gas spring dashpot may be mounted to the overhead arm and to the pivoting canopy section to limit inadvertent movement of the canopy section with respect to the overhead arm. According to the present invention, a pair of separate, laterally spaced apart, longitudinally extending sources of infrared heat, each having a deflector to direct the heat towards the patient support, may be included in the overhead arm. In such a system, the temperature of the environment where the patient resides may be adjusted by actuation of either or both infrared heaters or actuation of a third heater which heats air that is circulated beneath the canopy by an air circulation system of the patient-support apparatus.

Additional features and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
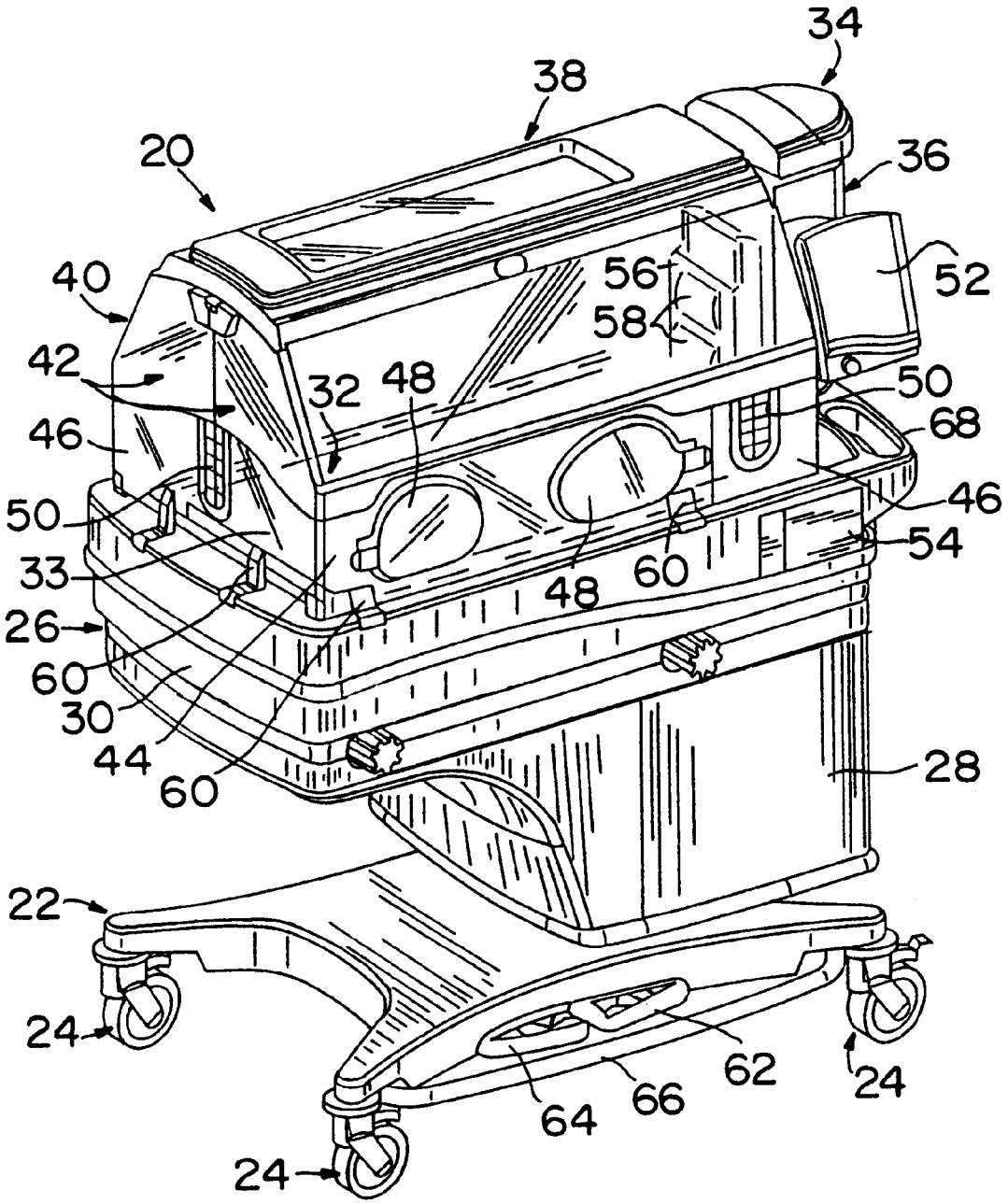
FIG. 1 is a perspective view of a patient-support apparatus according to the present invention showing a base, an infant supporting portion carried above the base, and a canopy support arm including an overhead arm extending over the infant supporting portion.

A thermal support apparatus or patient-support apparatus 20, such as an infant warming device or incubator, includes a base 22, a plurality of castors 24 extending downwardly from base 22, and an infant supporting portion or patient support 26 supported above base 22 as shown in FIG. 1. Patient support 26 includes a pedestal 28 coupled to base 22 for vertical movement, a platform tub 30 supported by pedestal 28, and a mattress 32 supported above platform tub 30. Mattress 32 has an upwardly facing patient-support surface 33. Patient-support apparatus 20 also includes a canopy support arm 34 including a telescoping vertical arm 36 and a horizontal overhead arm 38. A canopy 40 is coupled to overhead arm 38 and is positioned to lie above platform tub 30. Canopy 40 includes a pair of canopy halves 42 coupled to overhead arm 38 for pivoting movement between a lowered position, shown, for example, in FIGS. 1 and 7, and a raised position, shown in FIG. 8.

A pair of transparent side guard panels 44 and a pair of transparent end guard panels 46 extend upwardly from platform tub 30 as shown in FIG. 1. Side guard 25 panels 44 and end guard panels 46 cooperate with canopy halves 42 and overhead arm 38 to provide patient-support apparatus 20 with an isolation chamber. Side guard panels 44 may be formed to include a pair of access ports that are normally closed by access port covers 48. Access port covers 48 can be opened to allow access to a patient, such as an infant, supported by patient-support apparatus 20 within the isolation chamber. Each end 30 guard panel 46 is formed to include at least one U-shaped window and a pass-through grommet 50 is positioned to lie in each U-shaped window. Wires and tubes (not shown) can be routed into the isolation chamber through pass-through grommets 50.

Patient-support apparatus 20 includes a user interface panel 52 for monitoring various systems that control the temperature and humidity of the isolation chamber and for allowing caregivers to input various control parameters into memory of a control system of patient-support apparatus 20. Patient-support apparatus 20 also includes a humidifier module 54 that can be filled with water and inserted into a humidifier compartment of platform tub 30. Heated air is blown through humidifier module 54 and directed into the isolation chamber. A tower 56 is positioned to lie in the isolation chamber. Tower 56 supports various sensors 58, such as patient environmental sensors and light and noise sensors, and also provides a return-air path for the air being circulated through the isolation chamber.

Hinges 60 are provided so that side guard panels 44 and one of end guard panels 46 can pivot downwardly away from canopy 40 to provide increased access to the infant supported by patient-support apparatus 20. Up and down buttons (not shown) can be pressed to extend and retract vertical arm 36 of canopy support arm 34, thereby raising and lowering, respectively, overhead arm 38 and canopy 40. Patient-support apparatus 20 includes an up pedal 62 that can be depressed to raise patient support 26 relative to base 22 and a down pedal 64 that can be depressed to lower patient support 26 relative to base 22. Patient-support apparatus 20 includes a side bumper 66 that protects pedals 62, 64 and other components, such as base 22 and pedestal 28, from inadvertent impact. Platform tub 30 is formed to include a handle 68 on each side of canopy support arm 34. Handles 68 can be grasped by a caregiver to maneuver patient-support apparatus 20 during transport.

Other features of patient-support apparatus 20 are discussed in detail in co-pending applications Ser. No. 08/925,873 filed Sep. 9, 1997, pending Ser. No. 08/926,380 filed Sep. 9, 1997, pending Ser. No. 08/926,383 filed Sep. 9, 1997 pending 7175–28751); and Ser. No. 08/926,381 filed Sep. 9, 1997, pending; all of which are incorporated herein by reference.

Figure 2:
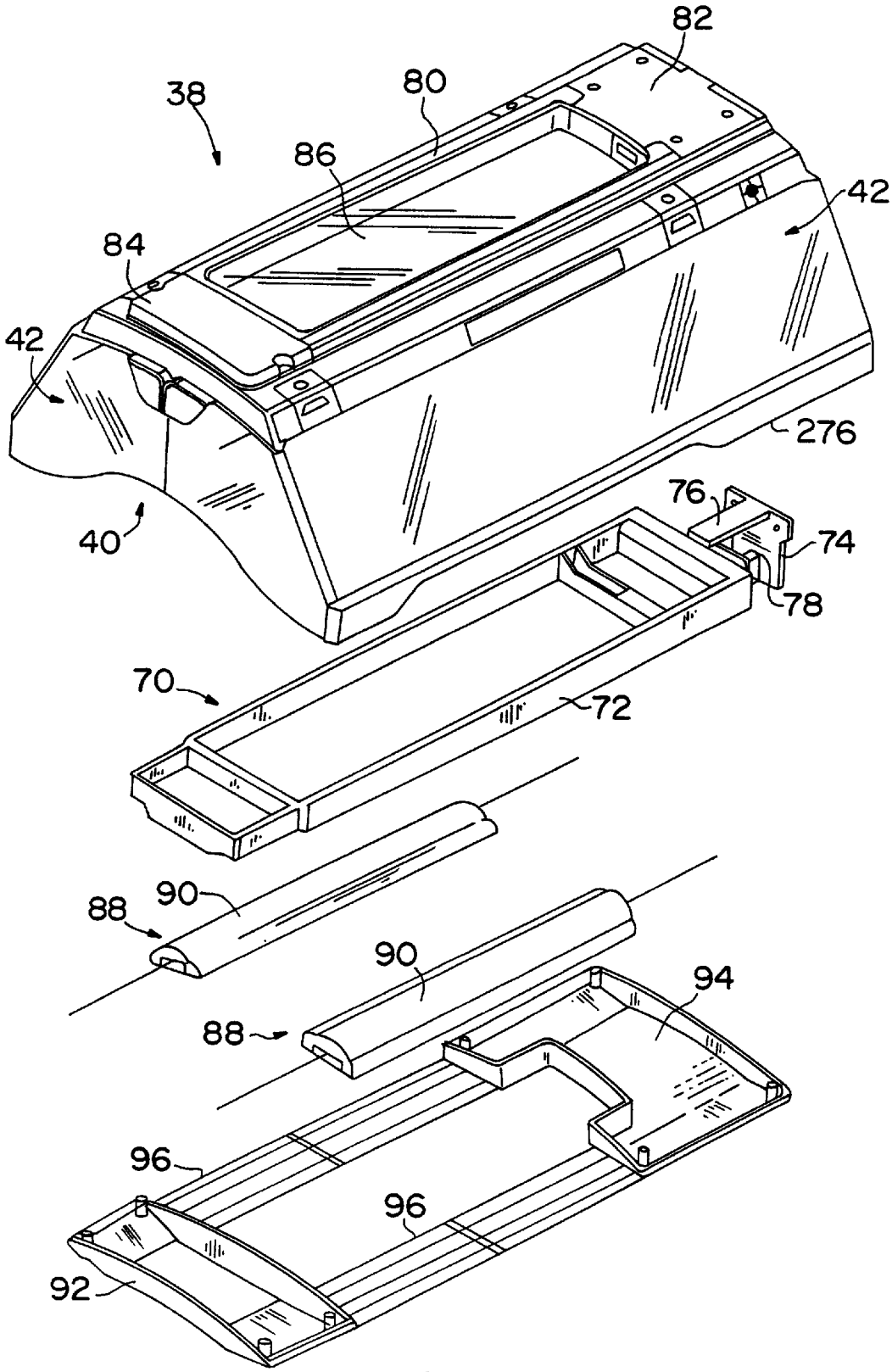
FIG. 2 is an exploded view of the overhead arm of FIG. 1 showing an overhead arm structural member, a top cover and canopy above the overhead arm structural member, a pair of infrared heater assemblies below the overhead arm structural member, and a pair of heater grills attached to front and rear bottom covers beneath the infrared heater assemblies.

Overhead arm 38 includes an overhead arm structural member 70 having a substantially rectangular frame member 72 and an end plate 74 coupled to frame member 72 by a horizontal flange 76 and a vertical flange 78 as shown in FIG. 2. Overhead arm structural member 70 is the component of overhead arm 38 that supports the other components of overhead arm 38. For example, overhead arm 38 includes a top cover 80 that overlies structural member 70 and is attached thereto. Canopy halves 42 are attached to top cover 80 for pivoting movement. In addition, overhead arm 38 includes a circuit board cover 82 that covers an electrical circuit (not shown) situated in a rear compartment formed in top cover 80 and an alarm light cover 84 that covers a set of alarm lights (not shown) situated in a front compartment formed in top cover 80. Overhead arm 38 includes an elongated x-ray window 86 received in a central aperture formed in top cover 80.

A pair of infrared heater assemblies 88 are coupled to overhead arm 38 below overhead arm structural member 70. Infrared heater assemblies 88 provide warmth to the patient supported on patient-support surface 33. Infrared heater assemblies 88 extend longitudinally and are laterally spaced apart from one another as shown in FIG. 2. Each infrared heater assembly 88 includes a deflector 90 to direct the heat towards patient support 26. Overhead arm 38 includes a front bottom cover 92 and a rear bottom cover 94, each of which couple to top cover 80. A pair of heater grills 96 are connected to and extend longitudinally between front and rear bottom covers 92, 94 beneath infrared heater assemblies 88.

Infrared heater assemblies 88 can be actuated to adjust the temperature of the environment in the isolation chamber where the patient resides. By providing patient-support apparatus 20 with two infrared heater assemblies 88 the IR frequency required to achieve a specific temperature at patient-support surface 33 is higher than if only one infrared heater is provided. In addition, providing patient-support device with two infrared heater assemblies 88 results in the heat energy being distributed over patient-support surface 33 more uniformly than if only one infrared heater were provided.

The canopy halves 42, side guard panels 44, and end guard panels 46 help to distribute the infrared energy from infrared heater assemblies 88 evenly throughout the isolation chamber. By properly aligning canopy 40 with side and end guard panels 44, 46, infrared heat losses are minimized. Patient-support apparatus 20 includes a third heater (not shown) which heats air that is circulated beneath canopy 40 by an air circulation system (not shown) of the patient-support apparatus 20. Humidifier module 54 also includes a heater to heat the water contained therein so that, as the heated air is circulated through humidifier module 54, the air is humidified. The heated air is directed upwardly adjacent to the side and end panels 44, 46 and is deflected by canopy 40 over patient-support surface 33. By properly aligning canopy 40 with side and end guard panels 44, 46 convective heat losses and air losses are minimized.

Patient-support apparatus 20 includes various sensors that provide data to a control system of the patient-support apparatus 20 so that the environment of the isolation chamber can be closely monitored and controlled. For example, patient-support apparatus 20 includes an air flow sensor, an air temperature sensor, and a humidity sensor. Patient-support apparatus 20 also includes a position sensor 98 shown in FIG. 3. Sensor 98 senses the position of overhead arm 38 relative to patient support 26. The radiant heat generated by infrared heater assemblies 88 is adjusted according to the position of overhead arm 38 sensed by sensor 98. In a preferred embodiment, sensor 98 is a linear variable displacement transducer. Thus, the temperature of the environment in the isolation chamber can be adjusted by one or more of: actuation of the heater of the air circulation system, vertical movement of canopy 40, and actuation of infrared heater assemblies 88. The environment in isolation chamber is further controlled by adjusting the velocity of the air in the air curtains adjacent to side and end guard panels 44, 46 when canopy halves 42 are moved between the raised and lowered positions and by adjusting the temperature of the heater in humidifier module 54.

Figure 3:
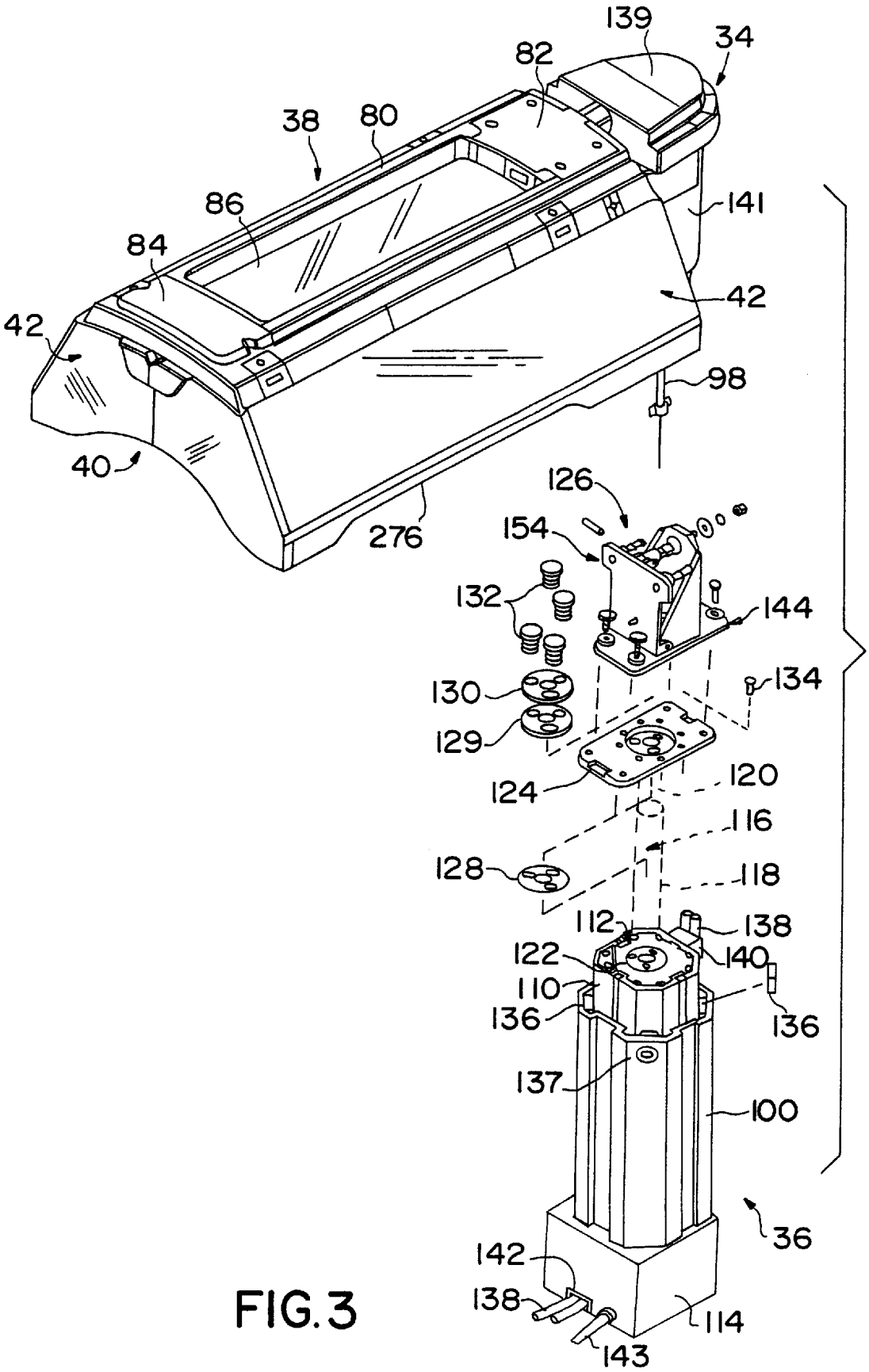
FIG. 3 is an exploded view of a portion of the canopy support arm of FIG. 1 showing a vertical arm of the canopy support arm having inner and outer tubular columns, a motor housing beneath the tubular columns, a telescoping lead screw extended out of the inner and outer tubular columns (in phantom), a rectangular drive plate above the telescoping lead screw, an adjustment mechanism above the drive plate, and the overhead arm above the adjustment mechanism.

Canopy support arm 34 includes vertical arm 36 and overhead arm 38 as previously described. Vertical arm 36 includes an outer tubular column 100, an inner tubular column 110, and a telescoping drive assembly 112 as shown in FIG. 3. Drive assembly 112 includes a motor (not shown) encased by a motor housing 114 and a telescoping lead screw 116 having a first tube 118 and a second tube 120 shown in FIG. 3 (in phantom). Tube 120 telescopically extends and retracts relative to tube 118 in response to actuation of the motor encased by motor housing 114.

Figure 5:
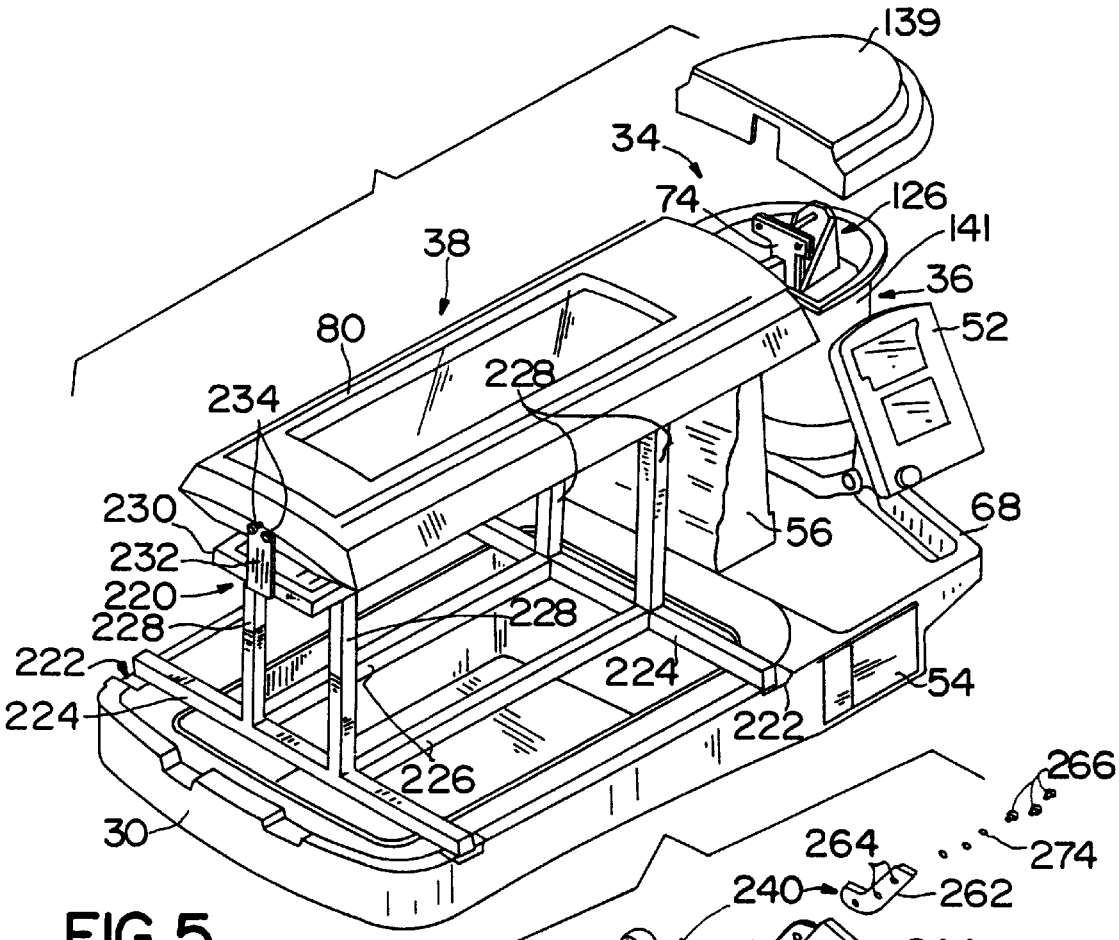
FIG. 5 is a perspective view of a part of the infant supporting portion and overhead arm of FIG. 1 showing an alignment jig carried by the infant supporting portion and configured to support the overhead arm at a correct alignment position relative to the infant supporting portion.

A round, column isolator plate 122 is mounted to the upper end of tube 120 of drive assembly 112 as shown in FIG. 3. Vertical arm 36 further includes a rectangular drive plate 124 supported above isolator plate 122 and an adjustment mechanism 126 supported above drive plate 124. A top cap 139 and a telescoping column cover 141 are arranged to encase alignment mechanism 126 and tubular columns 100, 110 as shown in FIGS. 3 and 5.

A first isolator pad 128 is sandwiched between isolator plate 122 and rive plate 124 as shown in FIG. 3. In addition, an isolator spacer 130 and a second isolator pad 129 are sandwiched between drive plate 124 and adjustment mechanism 126. A plurality of bolts 132 couple isolator spacer 130, drive plate 124, isolator pads 128, 129, and isolator plate 122 together. In addition, a plurality of screws 134, only one of which is shown in FIG. 3, couple drive plate 124 to an upper end of inner tubular column 110. Overhead arm 38 is coupled to alignment mechanism 126 in a cantilevered arrangement as will be discussed below in more detail with reference to FIGS. 4 and 5.

When the motor of drive assembly 112 is actuated to extend tube 120 relative to tube 118, drive plate 124 and alignment mechanism 126 are lifted upwardly. Upward movement of drive plate 124 pulls inner tubular column 110 upwardly relative to outer tubular column 100. In addition, upward movement of alignment mechanism 126 moves overhead arm 38 and canopy 40 upwardly relative to patient support 26. When the motor of drive assembly 112 is actuated to retract tube 120 relative to tube 118, drive plate 124 and alignment mechanism 126 are dropped downwardly. Downward movement of drive plate 124 pushes inner tubular column 110 downwardly relative to outer tubular column 100. In addition, downward movement of alignment mechanism 126 moves overhead arm 38 and canopy 40 downwardly relative to patient support 26. In a preferred embodiment, drive assembly 112 is a Model No. LA-28 drive supplied by Linak, located in Louisville, Ky.

Outer tubular column 100 and motor housing 114 are both fixed to patient support 26 and therefore, remain stationary relative to patient support 26 during vertical movement of overhead arm 38 and canopy 40 relative to patient support 26. A set of first glide pads 136 are coupled to the upper end of outer tubular column 100 and are arranged to engage inner tubular column 110. A set of second glide pads (not shown) are coupled to the bottom end of inner tubular column 110 and are arranged to engage an inner surface of outer tubular column 100. Engagement between first and second glide pads and respective outer and inner tubular columns 100, 110 supports inner tubular column 110 for sliding movement relative to outer tubular column 100.

A plurality of first adjustment screws 137 are threaded through outer tubular column 100 and couple to respective first glide pads 136 and a plurality of second adjustment screws (not shown) are threaded through inner tubular column 110 and couple to respective second glide pads. Each first adjustment screw 137 is rotated to adjust the frictional force between the respective first glide pad 136 and inner tubular column 110. In addition, each second adjustment screw is rotated to adjust the frictional force between the respective second glide pad and outer tubular column 100. Each second glide pad is positioned to lie vertically beneath the respective first glide pad 136 so that interference between first glide pads 136 and second glide pads prevents inner tubular column 110 from being lifted upwardly and separated from outer tubular column 100. In a preferred embodiment, inner and outer tubular columns 100, 110 are somewhat octagonal-shaped aluminum extrusions supplied by Magnode, located in Trenton, Ohio.

First glide pads 136 and the second glide pads ensure that inner tubular column 110 extends and retracts in a smooth manner relative to outer tubular column 100. First glide pads 136 and the second glide pads also function to dampen vibrations, such as vibrations generated by the motor of drive assembly 112, from being transmitted from inner tubular column 110 through outer tubular column 100 to patient support 26. In addition, isolator pad 128 is a resilient member that dampens vibrations from being transmitted from inner tubular column 110 through drive plate 124 and alignment mechanism 126 to overhead arm 38. Thus, first glide pads 136, the second glide pads, and isolator pad 128 lessen the noise and vibration between the components of canopy support arm 34, thereby minimizing the disturbance of the patient supported on patient-support surface 33 during raising and lowering of overhead arm 38 and canopy 40. For example, in comparison testing, the measured sound pressure level of the above-described arrangement is approximately 50 dBA, whereas the measured sound pressure level of the quietest tested prior art system is approximately 70 dBA.

The cantilevered arrangement of overhead arm 38 relative to vertical arm 36 results in a bending moment being created on vertical arm 36. The bending moment is transmitted from overhead arm 38 through alignment mechanism 126 and base plate 124 to inner tubular column 110. The bending load is ultimately transferred from inner tubular column 110 through outer tubular column 100 to patient support 26. Lead screw 116 of telescoping drive assembly 112 is arranged coaxially relative to outer and inner tubular columns 100, 110, as shown in FIG. 3. Isolator pads 128, 129 isolate drive assembly 112 from drive plate 124 and inner tubular column 110 so that drive assembly 112 is subjected to only negligible bending loads. In addition, inner tubular column 110 telescopes freely relative to outer tubular column 100 so that inner tubular column 110 is subjected to vertical loads generated by drive assembly 112. Thus, the bending moment created by overhead arm 38 and the components attached thereto is carried by outer and inner tubular columns 100, 110 and the vertical load created by overhead arm 38 and the components attached thereto is carried by drive assembly 112.

Patient-support apparatus 20 includes a control system as previously described. In addition, an electrical circuit and a set of alarm lights are contained within compartments formed in top cover 80 and infrared heater assemblies 88 are coupled to overhead arm 38 as also previously described. A coiled wire assembly 138 connects the control system, which is housed in patient support 26, to the electrical circuit, alarm light, and infrared heater assemblies 88 of overhead arm 38. A coiled portion (not shown) of coiled wire assembly 138 wraps around tubes 118, 120 of drive assembly 112 inside outer and inner tubular columns 100, 110. A portion of wire assembly 138 at the top of the coiled portion is fastened to the upper end of inner tubular column 110 by a first strain relief 140 and a portion of wire assembly 138 at the bottom of the coiled portion is fastened to motor housing 114 by a second strain relief 142 as shown in FIG. 3. In addition, a power cable 143, which is connected to the motor of drive assembly 112, exits motor housing 114 adjacent to second strain relief 142. The coiled portion of wire assembly 138 is configured to stretch and unstretch as drive assembly 112 extends and retracts, respectively.

Figure 4:
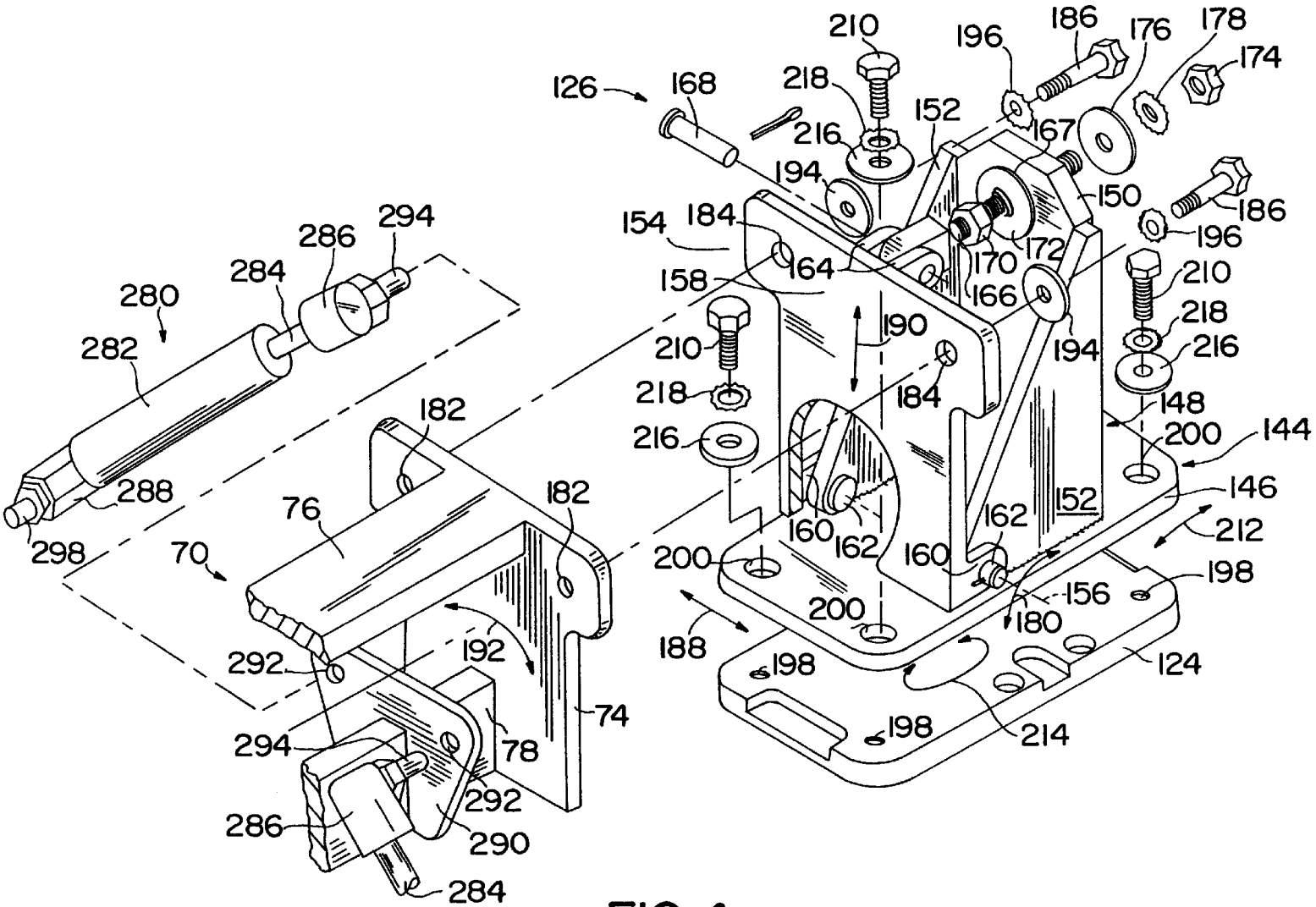
FIG. 4 is an enlarged exploded view of the adjustment mechanism of FIG. 3 showing a gusset structural member of the adjustment mechanism having a horizontal base plate configured to couple to the drive plate and a flange structure extending upwardly from the base plate, a pivot structural member pivotably coupled to the flange structure of the gusset structural member, an end plate of the overhead arm structural member configured to couple to the pivot structural member, and each of the base plate and pivot structural member being formed to include a plurality of oversized holes that receive respective mounting bolts therethrough.

As previously described, overhead arm structural member 70 is coupled to drive plate 124 by alignment mechanism 126. Alignment mechanism 126 includes a gusset structural member 144 having a horizontal bottom plate 146 and a flange structure 148 extending upwardly from bottom plate 146 as shown in FIG. 4. Bottom plate 146 is rectangular in shape and configured to attach to drive plate 124. Bottom plate 146 and drive plate 124 are substantially the same size. Flange structure 148 includes a vertical back plate 150 and a pair of spaced-apart, triangular side plates 152. Alignment mechanism 126 also includes a pivot structural member 154 that is coupled to gusset structural member 144 for pivoting movement about a transverse pivot axis 156. Pivot structural member 154 includes a substantially vertical front plate 158 and a pair of spaced-apart tabs 160 at the bottom of front plate 156. A pivot pin 162 couples each tab 160 to a bottom front portion of the respective side plate 152 of flange structure 148 at pivot axis 156.

A pair of flanges 164 are appended to the upper end of front plate 158 and extend therefrom toward back plate 150 of flange structure 148 as shown in FIG. 4. An adjuster rod or eye bolt 166 is pivotably coupled to flanges 164 by a pivot pin 168. Back plate 150 is formed to include an aperture 167 and eye bolt 166 extends from flanges 164 through aperture 167. A nut 170 and flat washer 172 are coupled to eye bolt 166 between pivot structural member 154 and back plate 150. In addition, a nut 174, flat washer 176, and lock washer 178 are coupled to eye bolt 166 behind back plate 150. Nuts 170, 174 are threadably adjusted on eye bolt 166 to move pivot structural member 154 in a pitch direction 180 about pivot axis 156 relative to gusset structural member 144. When pivot structural member 154 is in a desired position, such as when overhead arm 38 is parallel with patient support 26, nuts 170, 172 are tightened to clamp flat washers 172, 176 against back plate 150 and to clamp lock washer 178 against flat washer 176, thereby fixing pivot structural member 154 relative to gusset structural member 144.

Overhead arm structural member 70 attaches to pivot structural member 154 and extends forwardly therefrom in a cantilevered fashion. End plate 74 of overhead arm structural member 70 and front plate 158 of pivot structural member 154 are both generally T-shaped and have substantially the same size as shown in FIG. 4. A pair of threaded apertures 182 are formed in end plate 74 and a pair of oversized apertures 184 are formed in front plate 158 of pivot structural member 154. Apertures 184 are configured to align with apertures 182. A bolt 186 extends through each aperture 184 and is received in the respective threaded aperture 182 to couple overhead arm 38 to alignment mechanism 126. End plate 74 of overhead arm structural member 70 is arranged to abut front plate 158 of pivot structural member 154 when attached thereto.

Oversized apertures 184 have diameters that are larger than the diameter of bolts 186. By having the diameter of each aperture 184 larger than the diameter of each bolt 186, overhead arm 38 and alignment mechanism 126 are movable relative to each other in a transverse direction 188 and a vertical direction 190. In addition, overhead arm 38 can be rotated in a roll direction 192 relative to front plate 158. After pivot structural member 154 is adjusted in direction 180 to a desired position relative to gusset structural member 144 and overhead arm 38 is adjusted in directions 188, 190, 192 to a desired position relative to pivot structural member 154, bolts 186 are tightened so that respective flat washers 194 and lock washers 196 are clamped against front plate 158 of pivot structural member 154, thereby fixing overhead arm 38 relative to pivot structural member 154.

A threaded aperture 198 is formed in drive plate 124 adjacent to each corner thereof and an oversized aperture 200 is formed in bottom plate 146 adjacent to each corner thereof. Apertures 198 are configured to align with apertures 200. A bolt 210 extends through each aperture 200 and is received in the respective threaded aperture 198 to couple alignment mechanism 126 to drive plate 124. Thus, bottom plate 146 of gusset structural member 144 is supported above drive plate 124 of vertical arm 36.

Oversized apertures 200 each have a diameter that is larger than the diameter of bolts 210. Thus, gusset structural member 144 and the components attached thereto can be moved in transverse direction 188 and also in a longitudinal direction 212 relative to drive plate 124. In addition, gusset structural member 144 and the components attached thereto can be rotated in a yaw direction 214 relative to drive plate 124. After gusset structural member 144 has been adjusted in directions 188, 212, 214 to a desired position relative to drive plate 124, bolts 210 are tightened so that respective flat washers 216 and lock washers 218 are clamped against drive plate 124 of vertical arm 36, thereby fixing gusset structural member 144 relative to drive plate 124.

Figure 4A:
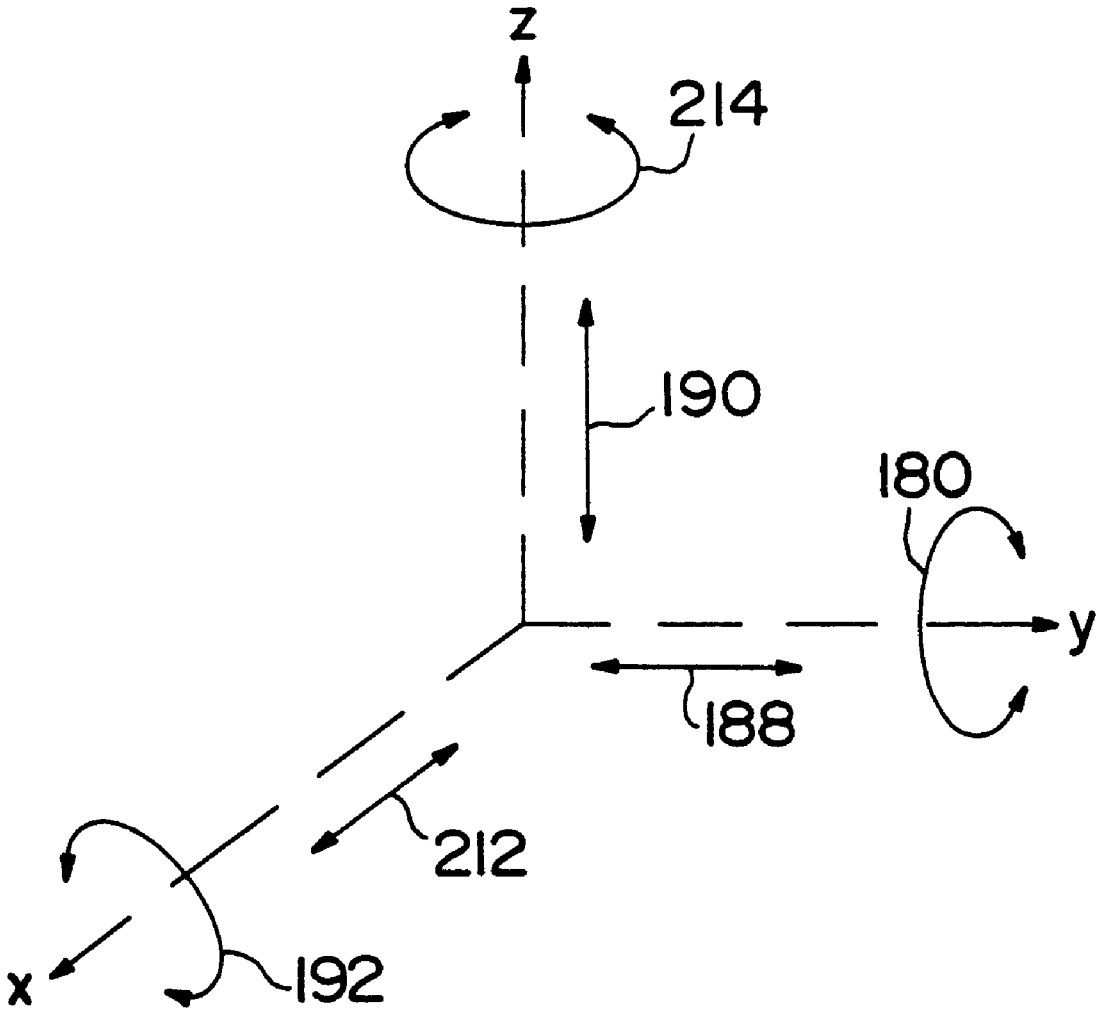
FIG. 4*a* is a diagrammatic view showing the degrees of freedom in which the alignment mechanism is movable to adjust the position of the overhead arm relative to the infant supporting portion.

Thus, alignment mechanism 126 is configured to allow overhead arm 38 to be moved in six degrees of freedom, i.e. directions 180, 188, 190, 192, 212, 214, relative to vertical arm 36. The six degrees of freedom 180, 188, 190, 192, 212, 214 are shown diagrammatically on a standard x-, y-, z-axis coordinate system in FIG. 4*a*. Alignment mechanism 126 is also configured to provide for the subsequent rigidity of overhead arm 38 relative to vertical arm 36. Alignment mechanism 126, therefore, is used to compensate for the tolerance stack-up of the various components of canopy support arm 34 so that overhead arm 38 is maintained in proper alignment position over patient support 26, which, as previously described, helps to uniformly distribute radiant heat energy, helps to prevent heat and air losses, and provides an aesthetically pleasing appearance for patient-support apparatus 20. Alignment mechanism 126 can support overhead arm 38 in an infinite number of positions throughout the entire range of motion that the components of adjustment mechanism 126 are movable.

Structural members 70, 144, 154 can be made out of any high modulus material by welding, bonding, bolting, or otherwise fastening together the various pieces of structural members 70, 144, 154. In addition, other configurations of alignment mechanism 126 that achieve movement in six degrees of freedom are possible. For example, an alternative alignment mechanism could include a plurality of turnbuckles, members that slide and rotate in openings formed in a primary member, or both.

An alignment jig 220 is used during the connection of overhead arm 38 to vertical arm 36 as shown in FIG. 5. Platform tub 30 includes a plurality of hinge recesses 222, each of which receive respective hinges 60 when patient-support apparatus 20 is completely assembled. Alignment jig 220 includes a pair of longitudinally spaced-apart, transverse frame members 224 and a pair of transversely spaced-apart, longitudinal frame members 226 that extend between transverse frame members 224 . The outer ends of frame members 224 are received in respective hinge recesses 222 and are coupled to platform tub 30. Thus, alignment jig 220 is supported temporarily by platform tub 30 during the manufacture of patient-support apparatus 20.

Alignment jig 220 further includes four vertical frame members 228 extending upwardly from transverse frame members 224 and a rectangular top frame 230 attached to the upper ends of vertical frame members 228. A first support flange 232 of alignment jig 220 extends upwardly from the front end of top frame 230. First support flange 232 is configured to engage a pair of front pivot posts 234 extending longitudinally away from overhead arm 38 as shown in FIG. 5. Alignment jig 220 also includes a second support flange (not shown) extending upwardly from the rear end to top frame 230 to engage a pair of rear pivot posts (not shown).

Engagement between first support flange 232 and front pivot posts 234 and engagement between the second support flange and the rear pivot posts supports overhead arm 38 in a correct alignment position relative to platform tub 30. When overhead arm 38 is in the correct alignment position, end plate 74 of overhead arm structural member 70 is held in its proper orientation along directions 190, 192 relative to vertical arm 36. While overhead arm 38 is supported in the correct alignment position, alignment mechanism 126 is loosely connected to drive plate 124 and to end plate 74. Appropriate adjustments are then made to alignment mechanism 126. For example, gusset structural member 144 is adjusted in directions 188, 212, 214; pivot plate is adjusted in direction 180; and isolator spacer 130 of appropriate thickness is inserted between bottom plate 146 and isolator pad 129 to adjust the position of all components of alignment mechanism 126 in direction 190 relative to overhead arm 38.

After the appropriate adjustments to alignment mechanism 126 are made, front plate 158 of pivot structural member 154 flushly abuts end plate 74. Nuts 170, 174 and bolts 186, 210 are tightened to rigidify alignment mechanism 126 relative to drive plate 124 and end plate 74, thereby fixing overhead arm 38 in the correct alignment position relative to platform tub 30. Front pivot posts 234 and the rear pivot posts are then removed from overhead arm 38 and transverse frame members 224 are decoupled from platform tub 30 so that alignment jig 220 can be pulled away from patient-support apparatus 20. Thus, alignment jig 220 defines the correct alignment position of overhead arm 38 relative to platform tub 30 and alignment mechanism 126 adjusts to properly mate overhead arm 38 to vertical arm 36.

Figure 6:
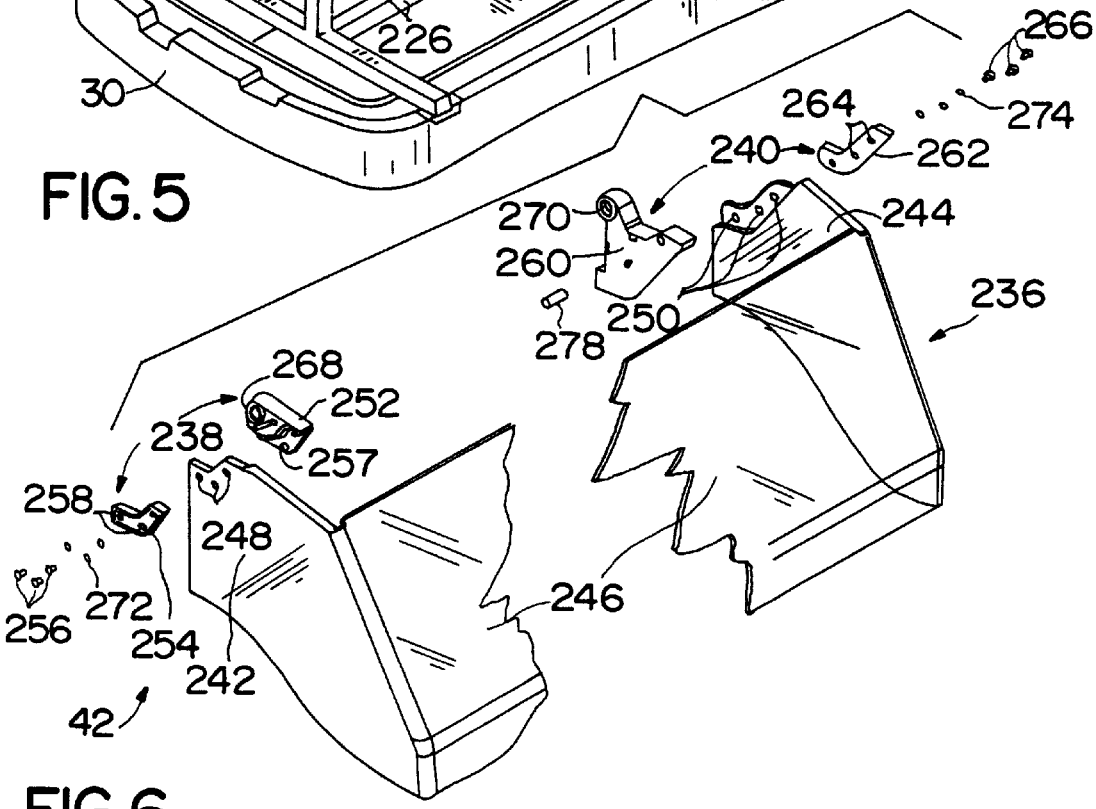
FIG. 6 is an exploded view of a canopy half of the canopy of FIG. 2 showing the canopy half including a transparent shield and adjustable hinge assemblies that attach the transparent shield to the overhead arm assembly.

After overhead arm 38 is rigidly mounted to vertical arm 36 in the correct alignment position, canopy halves 42 are mounted to overhead arm 38 by reattaching pivot posts 234 and the rear pivot posts to overhead arm with canopy halves 42 attached thereto. Each canopy half 42 includes a transparent shield 236, an adjustable front hinge assembly 238, and an adjustable rear hinge assembly 240 as shown in FIG. 6. The discussion below of one canopy half 42 is applicable to both canopy halves 42, unless specifically noted otherwise.

Transparent shield 236 includes a transverse front portion 242, a transverse rear portion 244, and a longitudinal side portion 246 extending between front and rear portions 242, 244. Front portion 242 is formed to include a set of oversized apertures 248 and rear portion 244 is formed to include a set of oversized apertures 250. Front hinge assembly 238 includes a hinge plate 252 and a hinge mate 254 as shown in FIG. 6. Hinge plate 252 and hinge mate 254 are positioned to lie on opposite sides of front portion 242 of transparent shield 236 and hinge mate 254 is formed to include a set of apertures 258. Front hinge assembly 238 further includes a set of screws 256, each of which extends through respective apertures 248, 258 and threadedly couples to a respective screw boss 257 formed in hinge plate 252.

Rear hinge assembly 240 includes a hinge plate 260 and a hinge mate 262. Hinge plate 260 and hinge mate 262 are positioned to lie on opposite sides of rear portion 242 of transparent shield 236 and hinge mate 262 is formed to include a set of apertures 264. Rear hinge assembly 240 further includes a set of screws 266, each of which extends through respective apertures 250, 264 and threadedly couples to a respective screw boss (not shown) formed in hinge plate 260. The screw bosses formed in hinge plate 260 are substantially similar to screw bosses 257 formed in hinge plate 252.

Hinge plate 252 of front hinge assembly 238 is formed to include a main pivot aperture 268 and hinge plate 260 of rear hinge assembly 240 is formed to include a main pivot aperture 270 as shown in FIG. 6. Front pivot posts 234 are received in main pivot apertures 268 of front hinge assemblies 238 of respective canopy halves 42 and the rear pivot posts are received in main pivot apertures 270 of rear hinge assemblies 240 of respective canopy halves 42. Hinge plates 252 pivot on respective front pivot posts 234 and hinge plates 260 pivot on respective rear pivot posts when canopy halves 42 are moved between the raised and lowered positions.

During assembly of canopy halves 42 onto overhead arm 38, front and rear hinge assemblies 238, 240 are loosely coupled to respective front and rear portions 242, 244 of transparent shield 236 so that screw bosses 257 are received in apertures 248 formed in front portion 242 and so that the screw bosses of hinge plate 260 are received in apertures 250 formed in rear portion 244. Hinge plates 252, 260 are then pivotably coupled to overhead arm assembly by the front and rear pivot posts. Next, transparent shields 236 are moved to respective proper alignment positions relative to side guard panels 44. The diameter of each of oversized apertures 248, 250 is larger than the diameter of each of screw bosses 257 of hinge plate 252 and the screw bosses of hinge plate 260 which allows transparent shields 236 to be moved relative to hinge assemblies 238, 240 while hinge assemblies 238, 240 are loose.

After transparent shields 236 are in the proper alignment positions relative to side guard panels 44, screws 256 are tightened so that hinge plates 252 and hinge mates 254 are clamped tightly against front portion 242 of respective transparent shields 236. In addition, screws 266 are tightened so that hinge plates 260 and hinge mates 262 are clamped tightly against rear portion 244 of respective transparent shields 236. A lock washer 272 is mounted on each screw 256 and a lock washer 274 is mounted on each screw 266. Screws 256 force each lock washer 272 against respective hinge mates 254 to keep each front hinge assembly 238 in a tightened configuration and screws 266 force each lock washer 274 against respective hinge mates 262 to keep each rear hinge assembly 240 in a tightened configuration. It should be understood that, when overhead arm 38 is fixed in the proper alignment position, canopy halves 42 will be substantially aligned with respective side guard panels 44 and that front and rear hinge assemblies 238, 240 are provided for making slight adjustments of canopy halves 42 relative to side guard panels 44.

Each canopy half 42 includes a seal 276 coupled to and extending longitudinally along the bottom edge of side portion 246 of the respective transparent shield 236, as shown, for example in FIG. 2. When canopy halves 42 and overhead arm 38 are in their respective proper alignment positions and when drive assembly 112 is actuated to move overhead arm 38 and canopy 40 down to a lowered position, shown in FIG. 1, seals 276 of each canopy half 42 sealingly engage an upper edge of respective side guard panels 44. Sealing engagement between seals 276 and the upper edges of side guard panels 44 prevents air and heat from escaping out of the isolation chamber between side portions 246 of canopy halves 42 and side guard panels 44.

A magnet 278 is mounted to hinge plate 260 of rear hinge assembly 240 as shown in FIG. 6. A plurality of proximity sensors (not shown) are mounted to overhead arm 38 and are arranged to sense the presence of magnet 278 when the respective canopy half 42 is in either the raised position or the lowered position. The proximity sensors are coupled to the control system of patient-support apparatus 20 and provide a signal thereto to indicate the position of canopy halves 42. The control system is programmed to alter the operation of the various systems of patient-support apparatus 20 depending upon the position of canopy halves 42. For example, the control system will cause the air circulating through platform tub 30 and into isolation chamber to be moved at a faster rate when the canopy halves 42 are in the raised position than when the canopy halves 42 are in the lowered position.

Figure 7:
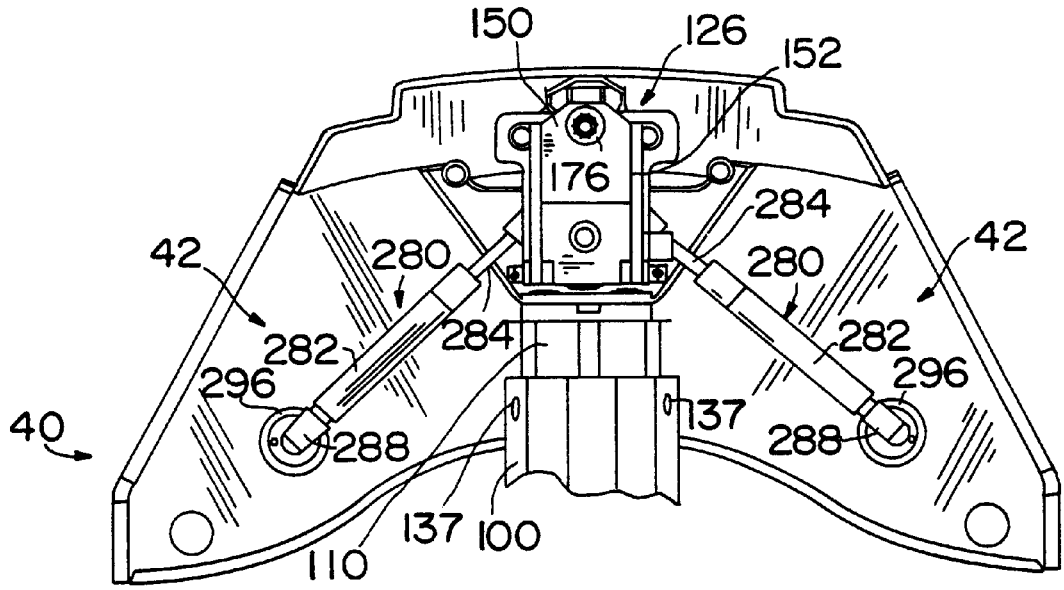
FIG. 7 is an end elevation view of the attachment mechanism, overhead arm, and canopy of FIG. 3 showing the canopy halves held in a lowered position by a pair of gas spring dashpots.
Figure 8:
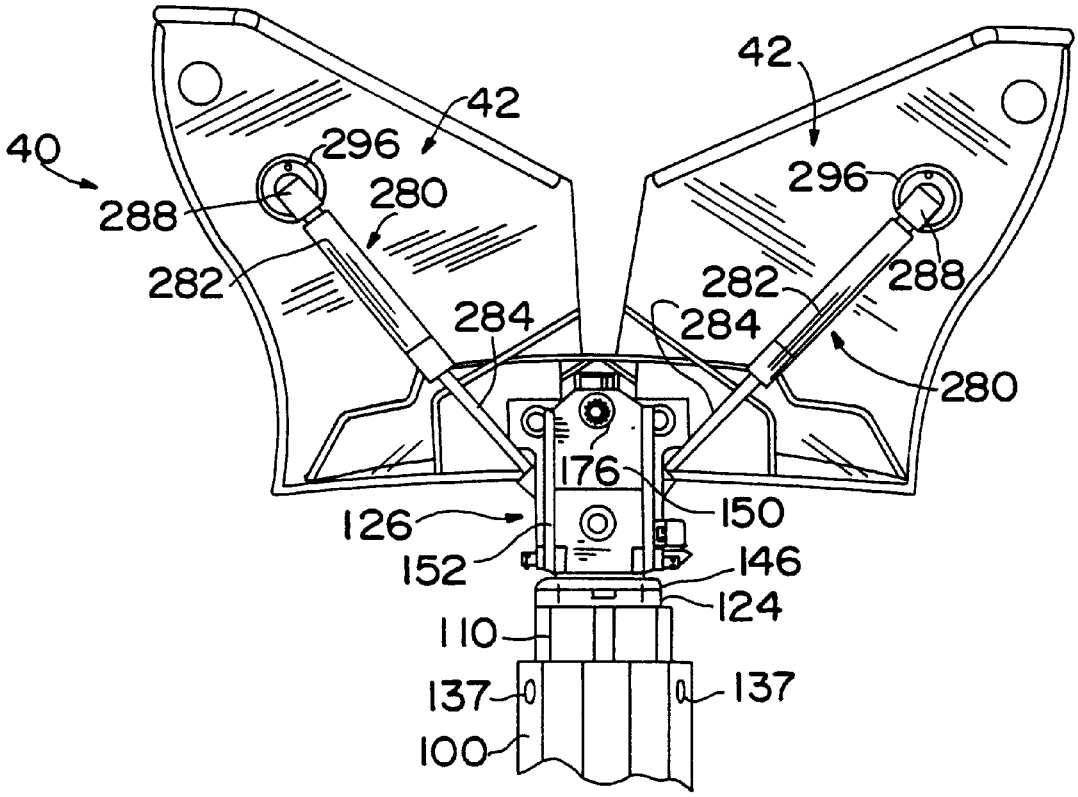
FIG. 8 is an end elevation view similar to FIG. 7 showing the canopy halves held in a raised position by the pair of gas spring dashpots.

A gas spring dashpot 280 couples each canopy half 42 to overhead arm 38 as shown in FIGS. 7 and 8. When canopy halves 42 are in the lowered position, gas spring dashpots 280 are in a retracted position, shown in FIG. 7, and when canopy halves 42 are in the raised position, gas spring dashpots 280 are in an extended position, shown in FIG. 8. Gas spring dashpots 280 operate to hold canopy halves 42 in the respective raised and lowered positions and to restrict inadvertent movement of canopy halves 42 relative to overhead arm 38 while in the raised and lowered positions.

Each gas spring dashpot 280 includes a cylindrical housing 282 and a piston rod 284 coupled to housing 282 for sliding movement. A mounting head 286 is coupled to the outer end of each piston rod 284 and a mounting head 288 is coupled to each housing 282 as shown best in FIG. 4. Overhead arm structural member 70 includes a mounting bracket 290 coupled to vertical flange 78. Mounting bracket 290 is formed to include a pair of apertures 292. Mounting head 286 of each gas spring dashpot 280 includes a rearwardly extending post 294 that is received in a respective aperture 292 to pivotably couple the respective gas spring dashpot 280 to mounting bracket 290. A mounting plug 296 is mounted to each rear portion 244 of transparent shields 236 as shown in FIGS. 7 and 8. Each mounting plug 296 is formed to include an aperture (not shown). Mounting head 288 of each gas spring dashpot 280 includes a forwardly extending post 298, shown in FIG. 4, that is received in a respective aperture formed in each mounting plug 296.

Although the invention has been described in detail with reference to a certain preferred embodiment, variations and modifications exist within the scope and spirit of the invention as described and as defined in the following claims.

We claim:

1. A patient-support apparatus comprising a base, a patient support on the base, an overhead arm located over the patient support, and a mounting assembly for attaching the overhead arm to the base, including an alignment mechanism to properly align the overhead arm with respect to the base, wherein the alignment mechanism provides for initial adjustment of the overhead arm relative to the base with respect to at least three different degrees of freedom and for subsequent rigidity of the overhead arm relative to the base after alignment.

2. The patient-support apparatus of claim 1, further comprising a drive assembly for raising the overhead arm with respect to the patient support.

3. The patient-support apparatus of claim 1, wherein the alignment mechanism provides for an initial adjustment with respect to at least four different degrees of freedom.

4. The patient-support apparatus of claim 1, wherein the alignment mechanism provides for an initial adjustment with respect to at least five different degrees of freedom.

5. The patient-support apparatus of claim 1, wherein the alignment mechanism provides for an initial adjustment with respect to at least six different degrees of freedom.

6. A patient-support apparatus comprising a base, a patient support on the base, an overhead arm located over the patient support, a canopy mounted to the overhead arm and supported over the patient support by the overhead arm, and a mounting assembly for attaching the overhead arm to the base, including an alignment mechanism to properly align the overhead arm with respect to the patient support, wherein the alignment mechanism has at least two relatively movable members, which said at least two relative moveable members are also relatively movable with respect to the overhead arm and the base and are fixedly secured to each other, the overhead arm and the base after alignment of the overhead arm relative to the patient support.

7. The patient-support apparatus of claim 6, wherein one of the at least two relatively movable members is movable in two orthogonal directions with respect to the base.

8. The patient-support apparatus of claim 7, wherein the one movable member that is moveable in two orthogonal directions with respect to the base is also rotatable about an axis that is orthogonal to a plane defined by the two orthogonal directions.

9. The patient-support apparatus of claim 6 wherein one of the at least two relatively movable members is movable in two orthogonal directions with respect to the canopy.

10. The patient-support apparatus of claim 8, wherein the one movable member that is moveable in two orthogonal directions with respect to the canopy is also rotatable about an axis that is orthogonal to a plane defined by the two orthogonal directions.

11. The patient-support apparatus of claim 6, wherein one of the at least two relatively movable members is slidably movable in one direction with respect to the canopy and rotatable with respect to the base along a first rotational axis orthogonal with the slidable direction.

12. The patient-support apparatus of claim 11, wherein said one of the at least two movable members that is slidably moveable in one direction with respect to the canopy is further rotatable with respect to the canopy along a second rotational axis orthogonal to the first rotational axis.

13. The patient-support apparatus of claim 12, wherein another of said at least two relatively movable members is slidable along two orthogonal directions with respect to the base.

14. The patient-support apparatus of claim 13, wherein the second movable member is also rotatable with respect to the base along a second axis orthogonal to the rotational axis of the first member.

15. A method for aligning an overhead arm of a patient-support apparatus over a patient support of the patient-support apparatus with respect to at least three different degrees of freedom, wherein the patient-support apparatus includes an alignment mechanism which couples the overhead arm to the patient support, the method comprising the steps of coupling an alignment jig to the patient support, positioning the overhead arm on the alignment jig in correct alignment position as defined by the jig, loosely connecting the alignment mechanism to one of the overhead arm and the patient support, loosely connecting the alignment mechanism to the other of the overhead arm and the patient support, adjusting the alignment mechanism so as to be able to support the overhead arm in the correct alignment position relative to the patient support when the loose connections are tightened, tightening the loose connections between the alignment mechanism and each of the overhead arm and the patient support, and removing the alignment jig.

16. The method of claim 15, wherein the alignment jig is fixedly secured to the support by bolts and is provided with members that contact the overhead arm and provide positioning points for the alignment of the overhead arm with respect to the patient support and wherein the overhead arm is positioned in accordance with the location of the positioning points.

17. A patient-support apparatus comprising a patient support having an upper surface, an overhead arm attached to the patient support for vertical movement relative to the upper surface of the patient support, at least one canopy shield pivotably attached to the overhead arm for movement between a first position relative to the overhead arm and a second position relative to the overhead arm, and a gas spring dashpot mounted to the overhead arm and the canopy shield to limit inadvertent movement of the canopy shield with respect to the overhead arm when the canopy shield is in the first and second positions.

18. The patient-support apparatus of claim 17, wherein the at least one canopy shield includes a first canopy shield and a second canopy shield, the gas spring dashpot connects the first canopy shield to the overhead arm, and further comprising a second gas spring dashpot connecting the second canopy shield to the overhead arm.

19. The patient-support apparatus of claim 18, wherein each of the first and second canopy shields includes a transverse front portion, a transverse rear portion, and a longitudinal side portion extending between the front and rear portions and the first and second gas spring dashpots are coupled to the rear portions of respective first and second canopy shields.

20. The patient-support apparatus of claim 19, wherein the overhead arm includes an overhead arm structural member having a mounting plate, a pair of apertures are formed in the mounting plate, and each of the first and second gas spring dashpots includes a post that is received for pivoting movement in respective apertures formed in the mounting plate.

21. The patient-support apparatus of claim 19, wherein the overhead arm includes a portion positioned to lie between the front portions and the rear portions of the first and second canopy shields and the rear portions of the canopy shield are positioned to lie between the respective first and second gas spring dashpots and the portion of the overhead arm positioned to lie between the front and rear portions of the first and second canopies.

22. The patient-support apparatus of claim 17, wherein the canopy shield extends upwardly from the overhead arm when in the first position, the canopy shield extends downwardly from the overhead arm when in the second position, the gas spring is in an extended configuration when the canopy shield is in the first position, and the gas spring is in a retracted configuration when the canopy shield is in the second position.

23. A patient-support apparatus comprising a base a patient support on the base, an overhead arm arranged above the patient support, a telescoping, vibration-resisting mounting system for connecting the overhead arm to the patient support, the mounting system including an outer tubular column, an inner tubular column coupled to the outer tubular column for telescoping movement, one of the inner and outer tubular columns being fixed to the overhead arm and the other of the inner and outer tubular columns being fixed to the patient support, the inner and outer columns being configured to resist bending loads created by the overhead arm, a telescoping drive assembly actuatable to extend and retract the inner and outer tubular columns to move the overhead arm relative to the patient support, the telescoping drive assembly including a first tube fixed to the patient support and a second tube that extends and retracts relative to the first tube in response to actuation of the drive assembly, and an isolator pad arranged between the second tube and the overhead arm, the isolator pad isolating the overhead arm from vibrations created by the drive assembly.

24. A patient-support apparatus comprising a patient support having an upper surface, an overhead arm coupled to the patient support and positioned to lie above the upper surface of the patient support, a canopy shield, and an adjustable hinge assembly coupling the canopy shield to the overhead arm for pivoting movement, the hinge assembly having first and second members normally securely fastened to the canopy shield that can be loosened to allow adjustment of the canopy shield relative to the hinge assembly and then can be tightened against the canopy shield to prevent movement between the canopy shield and the hinge assembly in the adjusted position of the canopy shield.

25. The patient-support apparatus of claim 24, wherein the canopy shield includes a hinge-engaging portion to which the first and second members of the hinge assemblies couple and the hinge-engaging portion is positioned to lie between the first and second members.

26. The patient-support apparatus of claim 25, wherein the hinge-engaging portion of the canopy shield is formed to include at least one aperture, the first member is formed to include at least one screw boss, the hinge assembly includes at least one screw extending through the at least one aperture and coupling to the at least one screw boss, the aperture having a diameter larger than a diameter of the screw boss to allow relative movement between the canopy shield and the hinge assembly, and the screw is coupled to the first and second members so that rotation of the screw tightens and loosens the first and second members relative to the hinge-engaging portion of the canopy shield.

27. The patient-support apparatus of claim 24, wherein one of the first and second members of the hinge assembly is formed to include a main aperture and further comprising a pivot post coupled to the overhead arm and received in the main aperture.

28. A patient-support apparatus comprising a base, a patient support on the base, a vertical arm extending upwardly from the patient support, a support plate mounted on the vertical arm, an overhead arm located over the patient support, the overhead arm including an end plate, and an alignment mechanism including a gusset structural member coupled to the support plate, a pivot structural member coupled to the end plate of the overhead arm, the pivot structural member being coupled to the gusset structural member for pivoting movement about an axis, and an adjuster connecting the pivot structural member to the gusset structural member, the adjuster being adjustable to move the pivot structural member about the axis relative to the gusset structural member, the alignment mechanism having a loosened configuration in which the overhead arm is slidably positionable relative to the pivot structural member and the gusset structural member is slidably positionable relative to the support plate, and the alignment mechanism having a tightened configuration in which the end plate of the overhead arm is fixed to the pivot structural member and the gusset structural member is fixed to the support plate.

29. The patient-support apparatus of claim 28, wherein the end plate includes a substantially flat surface, the pivot structural member includes a substantially flat surface, the flat surface of the end plate has a surface area substantially equal to a surface area of the flat surface of the pivot structural member, and the flat surface of the end plate abuts the flat surface of the pivot structural member when the alignment mechanism is in the tightened configuration.

30. The patient-support apparatus of claim 29, wherein the overhead arm extends away from the pivot structural member in a cantilevered arrangement.

31. The patient-support apparatus of claim 28, wherein the pivot structural member is formed to include a set of apertures, the alignment mechanism includes a set of bolts, and each bolt extends through a respective one of the set of apertures and threadedly couples to the end plate of the overhead arm.

32. The patient-support apparatus of claim 31, wherein each aperture has a first diameter, each bolt has a second diameter, and the second diameter is less than the first diameter so that, before the bolts are tightened, the pivot structural member is movable relative to the end plate of the overhead arm.

33. The patient-support apparatus of claim 28, wherein the gusset structural member is formed to include a set of apertures, the alignment mechanism includes a set of bolts, and each bolt extends through a respective one of the set of apertures and threadedly couples to the support plate.

34. The patient-support apparatus of claim 28, wherein the pivot structural member includes a front plate, the gusset structural member includes a bottom plate, each of the end plate and front plate are substantially vertical when the alignment mechanism is in the tightened configuration, and each of the bottom plate and support plate are substantially horizontal when the alignment mechanism is in the tightened configuration.

35. The patient-support apparatus of claim 28, wherein the gusset structural member includes a vertical flange structure, the pivot structural member includes a front plate, and the adjuster connects a top portion of the front plate with a top portion of the flange structure.

36. The patient-support apparatus of claim 35, wherein the flange structure includes a back plate and a pair of side plates coupled to the back plate, the adjuster couples the front plate of the pivot structural member to the back plate of the flange structure, and the adjuster is positioned to lie between the side plates of the flange structure.

37. The patient-support apparatus of claim 36, wherein the back plate is formed to include an aperture, the adjuster includes a bolt extending through the aperture and a pair of bolts threadedly coupled to the bolt on opposite sides of the back plate, the pair of bolts are movable on the bolt to change the position of the pivot structural member relative to the gusset structural member, and the bolts are movable on the bolt to clamp against the back plate to prevent movement of the pivot structural member relative to the gusset structural member.

38. The patient-support apparatus of claim 37, wherein the pivot structural member is pivotably coupled to the side plates of the flange structure.

39. The patient-support apparatus of claim 35, wherein the pivot structural member is pivotably coupled to a bottom portion of the flange structure.

* * * * *